US008106831B2

(12) United States Patent
Sato

(10) Patent No.: US 8,106,831 B2
(45) Date of Patent: Jan. 31, 2012

(54) CIRCUIT BOARD AND TELEPHONE APPARATUS

(75) Inventor: Katsuhiro Sato, Kani (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 619 days.

(21) Appl. No.: 12/289,233

(22) Filed: Oct. 23, 2008

(65) Prior Publication Data

US 2009/0109100 A1 Apr. 30, 2009

(30) Foreign Application Priority Data

Oct. 25, 2007 (JP) ..... 2007-277133

(51) Int. Cl.
*H01Q 1/38* (2006.01)

(52) U.S. Cl. ..... 343/700 MS

(58) Field of Classification Search ..... 343/700 MS, 343/702, 846, 848
See application file for complete search history.

(56) References Cited

U.S. PATENT DOCUMENTS 5,760,746 A * 6/1998 Kawahata ..... 343/702
6,255,994 B1 * 7/2001 Saito ..... 343/700 MS
6,281,848 B1 * 8/2001 Nagumo et al. ..... 343/700 MS
6,876,329 B2 * 4/2005 Milosavljevic ..... 343/700 MS
7,259,719 B2 8/2007 Horie et al.
2004/0207559 A1 * 10/2004 Milosavljevic ..... 343/702
2007/0290939 A1 * 12/2007 Teshirogi et al. ..... 343/795

FOREIGN PATENT DOCUMENTS

| | | |
|---|---|---|
| JP | A-06-334421 | 12/1994 |
| JP | A-07-113365 | 5/1995 |
| JP | A-2000-124735 | 4/2000 |
| JP | A-2000-221250 | 8/2000 |
| JP | A-2004-056506 | 2/2004 |

* cited by examiner

*Primary Examiner* — Huedung Mancuso
(74) *Attorney, Agent, or Firm* — Oliff & Berridge, PLC

(57) ABSTRACT

A circuit board is provided. The circuit board including a dielectric substrate; a ground electrode formed on the dielectric substrate; a radiation line formed on the dielectric substrate, at least a part of the radiation line including an open end and opposed to the ground electrode; a feeding line connected to the other end of the radiation line, the feeding line configured to feed high frequency signals to the radiation line or receive high frequency signals generated in the radiation line; a short-circuit line formed on the dielectric substrate and connected to the radiation line; a short-circuit element configured to short-circuit the short-circuit line and the ground electrode; and a connection terminal provided on the short-circuit line, wherein the connection terminal connects one end of the short-circuit element to the short-circuit line at a connection position and is configured so that the connection position is changeable.

18 Claims, 5 Drawing Sheets

CIRCUIT BOARD AND TELEPHONE APPARATUS

CROSS-REFERENCE TO RELATED APPLICATION

This application claims priority from Japanese Patent Application No. 2007-277133, filed on Oct. 25, 2007, the entire subject matter of which is incorporated herein by reference.

TECHNICAL FIELD

Aspects of the present invention relate to a circuit board and a telephone apparatus.

BACKGROUND

There has been an antenna, in which a conductor is patterned and formed on the surface of a circuit board, for the purpose of reducing the size. As this type of antenna, for example, a so-called inverted F-type antenna has been widely known. JP-A-2004-56506 describes an inverted F-type antenna formed on a dielectric substrate 21.

The inverted F-type antenna described in the publication has such a structure in which a radiation electrode 22 is formed by releasing one end of a conductor film formed from one surface of the dielectric substrate 21 to one side and connecting the other end part of the side to the ground electrode 23 provided on the rear side, and a feeding pin 24 is connected to a feeding point 22*a* located at a side nearer to the connection end with the ground electrode 23 via through holes in the dielectric substrate 21 and the ground electrode 23.

The resonance frequency of the inverted F-type antenna is determined by the length of the radiation electrode 22 and the dielectric constant of the dielectric substrate 21. That is, as the radiation electrode 22 becomes longer, the resonance frequency becomes lower. If the length of the radiation electrode 22 is the same, as the dielectric constant of the dielectric substrate 21 becomes larger, the resonance frequency becomes lower. In addition, it is known that the resonance frequency of the inverted F-type antenna is varied even by the length between the connection end of the radiation electrode 22 with the ground electrode 23 and the feeding point 22*a*. The resonance frequency becomes lower as the length between the connection end of the radiation electrode 22 with the ground electrode 23 and the feeding point 22*a* becomes shorter.

Meanwhile, a conductor pattern of an antenna designed for one circuit board is desired to be used for another circuit board. However, as described above, since the resonance frequency of the inverted F-type antenna described in the publication is determined by the dielectric constant of the dielectric substrate 21, the resonance frequency of the antenna is varied if the same conductor pattern is used for a circuit board (dielectric substrate) having a different dielectric constant. Therefore, in order to obtain a desired resonance frequency in different circuit boards, there is a problem that the conductor pattern of an antenna is designed for each of the circuit boards according to the dielectric constant of the circuit board.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a circuit board capable of adjusting the characteristics of an antenna after the antenna is formed, and a telephone apparatus using the same circuit board.

According to an exemplary embodiment of the present invention, there is provided a circuit board including: a dielectric substrate; a ground electrode formed on the dielectric substrate; a radiation line formed on the dielectric substrate, at least a part of the radiation line including an open end and opposed to the ground electrode; a feeding line connected to the other end of the radiation line, the feeding line configured to feed high frequency signals to the radiation line or receive high frequency signals generated in the radiation line; a short-circuit line formed on the dielectric substrate and connected to the radiation line; a short-circuit element configured to short-circuit the short-circuit line and the ground electrode; and a connection terminal provided on the short-circuit line, wherein the connection terminal connects one end of the short-circuit element to the short-circuit line at a connection position and is configured so that the connection position is changeable.

According to another exemplary embodiment of the present invention, there is provided a circuit board including: a dielectric substrate; a ground electrode formed on the dielectric substrate; a radiation line formed on the dielectric substrate, at least a part of the radiation line including an open end and opposed to the ground electrode; a feeding line connected to the other end of the radiation line, the feeding line configured to feed high frequency signals to the radiation line or receive high frequency signals generated in the radiation line; a short-circuit element configured to short-circuit the radiation line and the ground electrode; and a connection terminal provided on the radiation line, wherein the connection terminal connects one end of the short-circuit element to the radiation line at a connection position and is configured so that the connection position is changeable.

According to a further exemplary embodiment of the present invention, there is provided a telephone apparatus for carrying out a wireless communication, including; the above circuit board; and a signal processing circuit configured to generate the high frequency signals fed to the circuit board and process the high frequency signals received from the circuit board.

BRIEF DESCRIPTION OF THE DRAWINGS

The above and other aspects of the present invention will become apparent and more readily appreciated from the following description of exemplary embodiments of the present invention taken in conjunction with the attached drawings, in which.

DETAILED DESCRIPTION

First Exemplary Embodiment

Figure 1:
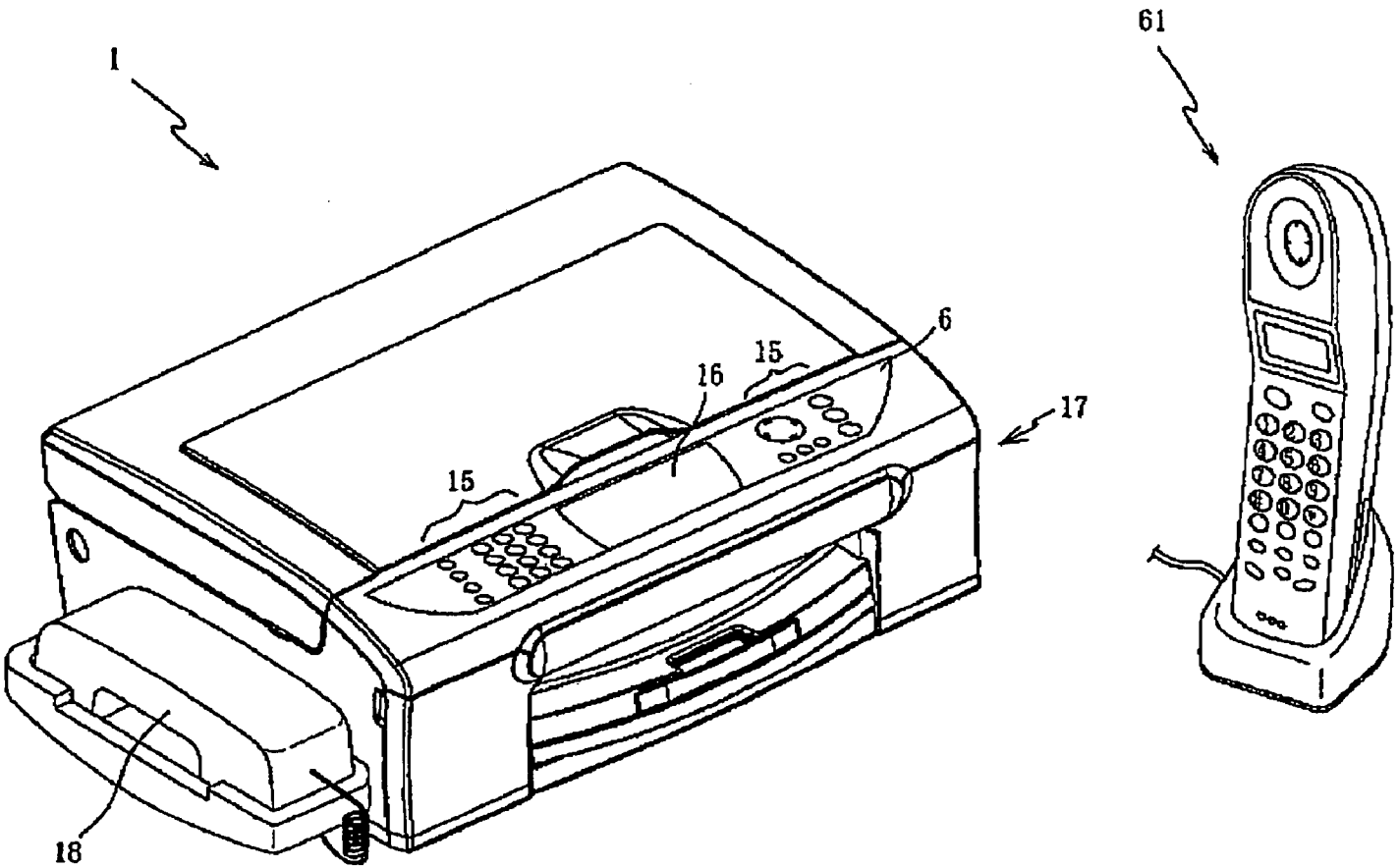
FIG. 1 is a perspective view showing the outer configuration of a multi-function peripheral (MFP) and a cordless handset including a circuit board according to a first exemplary embodiment of the present invention.

Hereinafter, exemplary embodiments of the present invention will be described with reference to the accompanying drawings. FIG. 1 is a perspective view showing the outer configuration of a multi-function peripheral 1 (hereinafter referred to as MFP) and a cordless handset 61 including a circuit board 17 according to a first exemplary embodiment of the present invention.

The MFP 1 is an apparatus for carrying out data transmission and telephone calls via wireless communications. The MFP 1 includes a digital cordless type handset 61 for carrying out telephone calls with the MFP 1 serving as a main device or a peripheral device (not shown) connected via a telephone line network. The MFP 1 has a cordless telephone call function by which telephone calls are carried out with the cordless handset 61 via wireless communications.

A circuit board 17 to carry out a cordless telephone call function is incorporated in the housing of the MFP 1. The circuit board 17 is formed with an inverted F-type antenna including a conductor pattern and a zero-ohm chip resistor 23 (see FIG. 2). Using the antenna, electric waves are transmitted to the cordless handset 61 and are received from the cordless handset 61. The circuit board 17 is configured to adjust the characteristics of an antenna after the antenna is formed on the circuit board 17.

A laterally long-shaped operation panel 6 is provided at the front part of the upper surface of the MFP 1, and the panel 6 is equipped with operation keys 15 and a liquid crystal display 16 (hereinafter called "LCD 16"). The operation keys 15 include operation input keys to operate the MFP 1. By pressing the operation input keys, a user can start a telephone call with a cordless handset 61 by starring wireless communications and can connect to a peripheral device via a telephone line network by inputting a telephone number. The LCD 16 displays operation procedures and a status of processing currently in operation, and displays information corresponding to pressing of the operation keys 15.

A handset 18 is provided at one side of the MFP 1. The handset 18 is a device for carrying out telephone calls and includes a microphone and a speaker. The microphone converts input voices to analog voice signals (electric signals), and the speaker output voices after converting the analog voice signal to voices.

Figure 2A:
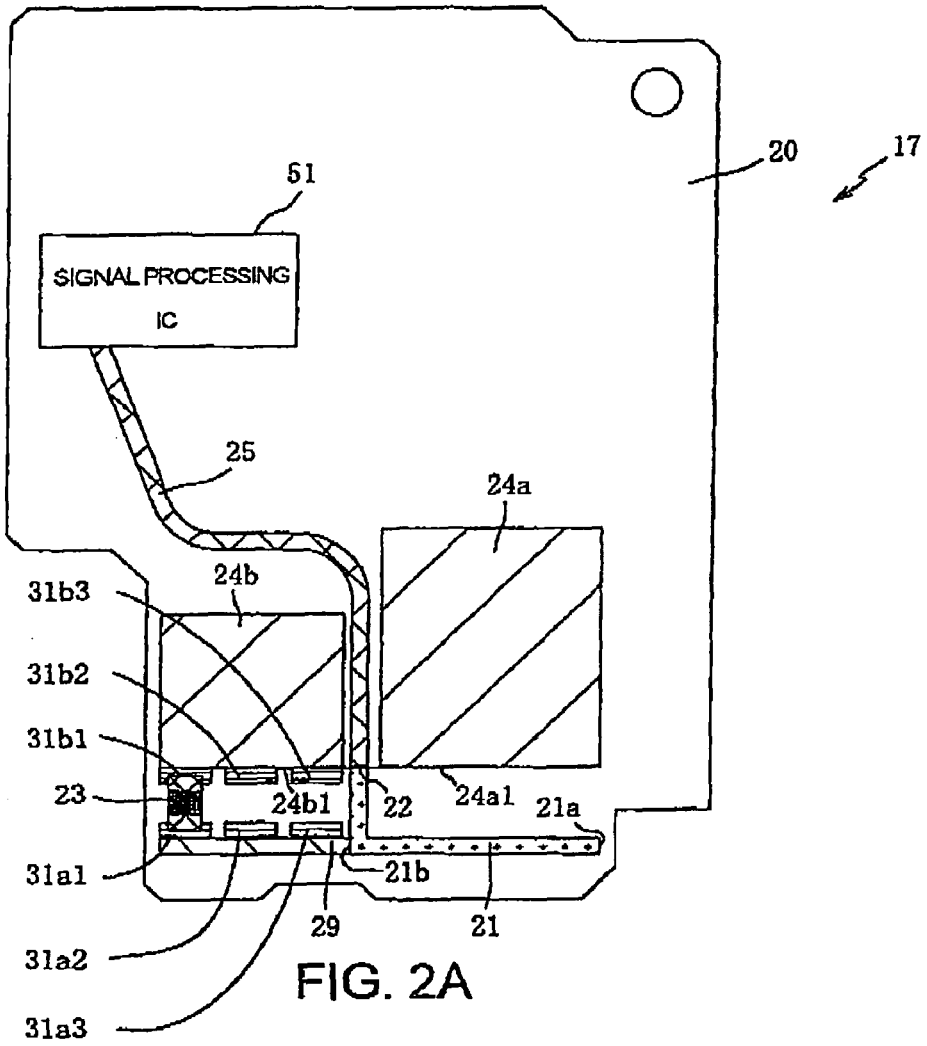
FIG. 2A is a plan view showing a detailed configuration of the circuit board.

Referring to FIG. 2A, a detailed configuration of the circuit board 17 will be described. FIG. 2A is a plan view showing a detailed configuration of the circuit board 17. As shown in FIG. 2A, two ground electrodes 24*a* and 24*b* are formed to be rectangular, respectively, on the dielectric substrate 20 of the circuit board 17 so that one side 24*a*1 of the ground electrode 24*a* and one side 24*b*1 of the ground electrode 24*b* are almost aligned on the same straight line with each other.

Also, a radiation line 21 is formed to have an L-shape, and one side including an open end 21*a* is opposed to the side 24*a*1 of the ground electrode 24*a* with a predetermined space. On the other hand, the other end (feeding point) 22 of the radiation line 21 is formed on a straight line connecting the side 24*a*1 of the ground electrode 24*a* to the side 24*b*1 of the ground electrode 24*b* between two ground electrodes 24*a* and 24*b*.

Further, a feeding line 25 is formed so that the feeding line 25 is connected to the radiation line 21 at the feeding point 22 and is connected to a signal processing integrated circuit 51 (hereinafter referred to as "signal processing IC 51") while passing between two ground electrodes 24*a* and 24*b*. Further, a short-circuit line 29 is formed to be opposed to the ground electrode 24*b* with a predetermined space and is connected to the radiation line 21 at the connection position 21*b* which is a right angle portion of the radiation line 21.

These ground electrodes 24*a*, 24*b*, radiation line 21, feeding line 25 and short-circuit line 29 are formed by, for example, patterning a metal in a predetermined pattern, that is, by a conductor pattern. As described later, an antenna is composed on the circuit board 17 by the ground electrodes 24*a*, 24*b*, the radiation line 21 and the feeding line 25.

In addition, the ground electrode 24*b* and the short-circuit line 29 are connected to each other by a zero-ohm chip resistor 23. Therefore, the radiation line 21 and the ground electrode 24*b* are short-circuited via a short-circuit line 29 and the zero-ohm chip resistor 23. That is, the antenna on the circuit board 17 is composed as an inverted F-type antenna. As described later, the characteristics of the antenna are adjusted by the connection position of the zero-ohm chip resistor 23 with the short-circuit line 29.

Next, a detailed configuration of respective parts will be described. The ground electrodes 24*a* and 24*b* are electrodes to define the grounding reference of the antenna formed on the circuit board 17. The ground electrodes 24*a* and 24*b* are electrically connected to the housing of the MFP 1, respectively, and are kept at the same potential as that of the housing of the MFP 1 at all times.

Also, a plurality (three in the first exemplary embodiment) of connection terminals 31*b*1, 31*b*2 and 31*b*3 are formed on the ground electrode 24*b* so that they are opposed to the short-circuit line 29 with a predetermined space. The connection terminals 31*b*1, 31*b*2 and 31*b*3 are composed of a land formed by patterning a conductor so that they are brought into contact with the outer edge of the ground electrode 24*b*.

One end of the zero-ohm chip resistor 23 is connected to the connection terminals 31*b*1, 31*b*2 and 31*b*3. By connecting one end of the zero-ohm chip resistor 23 to any one of the connection terminals 31*b*1, 31*b*2 and 31*b*3, the zero-ohm chip resistor 23 is electrically connected to the ground electrode 24*b*. Since the connection terminals 31*b*1, 31*b*2 and 31*b*3 are composed by a land as described above, the connection terminals 31*b*1, 31*b*2 and 31*b*3 can be used as marks of connection positions of the zero-ohm chip resistor 23 when connecting one end of the zero-ohm chip resistor 23 by means of a chip mounter.

The radiation line 21 is an electrode that converts high frequency signals to electric waves to transmit, or converts electric waves to high frequency signals to receive. At the radiation line 21, one end 21*a* of one side opposed to the ground electrode 24*a* is open. An intensive electric field is generated from the open end 21 with the grounding potential made into reference to emit electric waves to space.

The feeding line 25 is a line that feeds high frequency signals generated by the signal processing IC 51 from the feeding point 22 to the radiation line 21, or receives high frequency signals generated in the radiation line 21 from the feeding point 22 and transmit it to the signal processing IC.

The signal processing IC 51 is a circuit for controlling a cordless communication function with which telephone calls are carried out with the cordless handset 61 by wireless communication. The signal processing IC 51 performs modulation processing on voice data to be transmitted to the cordless handset 61 by wireless communication and generates high frequency signals. And, the signal processing IC 51 superimposes the generated high frequency signals onto the feeding line 25 and feeds to the radiation line 21 via the feeding line 25. Accordingly, electric waves corresponding to the high frequency signals are emitted from the radiation line 21.

Further, the signal processing IC 51 performs demodulation processing on high frequency signals that are generated in the radiation line 21 by electric waves transmitted from the cordless handset 61 and are received by the feeding line 25. Accordingly, the voice data transmitted from the cordless handset 61 are received by the MFP 1.

Thus, the antenna is composed of the ground electrodes 24*a*, 24*b*, radiation line 21 and feeding line 25, which are formed on the circuit board 17. A cordless communication function with the cordless handset 61 is embodied by the antenna formed on the circuit board 17.

The feeding line 25 connected to the signal processing IC 51 is connected to the ground electrode (not shown) connected to the housing of the MFP 1 in the signal processing IC 51. Therefore, the direct current potential of the feeding line 25 is kept at the same potential as that of the housing of the MFP 1, wherein high frequency signals are superimposed on the direct current potential.

The short-circuit line 29 is a line for short-circuiting the radiation electrode 21 and the ground electrode 24*b*. And, a plurality (three in the first exemplary embodiment) of connection terminals 31*a*1, 31*a*2, and 31*a*3 are formed at positions apart from the connection portion 21*b* of the short-circuit line 29 with the radiation electrode 21 in the short-circuit line 29 so that they are opposed to and apart from the connection terminals 31*b*1, 31*b*2, and 31*b*3 formed at the ground electrode 24*b* with the predetermined space (the length according to the size of the zero-ohm chip resistor 23), respectively. The connection terminals 31*a*1, 31*a*2 and 31*a*3 are composed of lands formed by patterning conductors at the outer edge of the short-circuit line 29 so as to be brought into contact with the short-circuit line 29.

One end of the zero-ohm chip resistor 23 is connected to the connection terminals 31*a*1, 31*a*2 and 31*a*3, and the other end of the zero-ohm chip resistor 23 connected to the connection terminals 31*b*1, 31*b*2 and 31*b*3 provided at the ground electrode 24*b* is connected to any one of the connection terminals 31*a*1, 31*a*2 and 31*a*3. Accordingly, the zero-ohm chip resistor 23 is electrically connected to the short-circuit line 29.

Since the connection terminals 31*a*1, 31*a*2 and 31*a*3 are configured as described above, the connection terminals 31*a*1, 31*a*2 and 31*a*3 may be used as marks for connection position of the zero-ohm chip resistor 23 when connecting one end of the zero-ohm chip resistor 23 by a chip mounter.

The zero-ohm chip resistor 23 is an element in which a resistor, the resistance value of which is zero ohm, is packaged by surface mounting, and functions as a jumper element by which two points on a circuit are short-circuited. The zero-ohm chip resistor 23 is mounted on the circuit board 17 after forming the ground electrodes 24*a*, 24*b*, radiation line 21, feeding line 25, short-circuit line 29, connection terminals 31*a*1, 31*a*2 and 31*a*3 and connection terminals 31*b*1, 31*b*2 and 31*b*3 on the circuit board 17 by patterning conductors. A resistor included in the zero-ohm chip resistor 23 may be such a type the resistance value of which can be regarded to be substantially zero ohm.

At this time, the zero-ohm chip resistor 23 is configured to be mounted on the circuit board 17 so that one end thereof is connected to the connection terminal 31*a*1 while the other end thereof is connected to the connection terminal 31*b*1, one end thereof is connected to the connection terminal 31*a*2 while the other end thereof is connected to the connection terminal 31*b*2, or one end thereof is connected to the connection terminal 31*a*3 while the other end thereof is connected to the connection terminal 31*b*3. FIG. 2A shows an example in which one end of the zero-ohm chip resistor 23 is connected to the connection terminal 31*a*1, and the other end thereof is connected to the connection terminal 31*b*1.

Accordingly, the short-circuit line 29 equipped with the connection terminals 31*a*1, 31*a*2, and 31*a*3 is short-circuited to the ground electrode 24*b* equipped with the connection terminals 31*b*1, 31*b*2, and 31*b*3, and an inductance component is generated from the connection position 21*b* between the radiation line 21 and the short-circuit line 29 to the ground electrode 24*b*. Since parasitic capacitance (reactance component) occurring at a portion having the radiation line 21 opposed to the ground electrode 24*a* is cancelled by the inductance component, the resonance characteristics of the antenna formed on the circuit board 17 can be improved.

If the short-circuit line 29 and the ground electrode 24*b* are short-circuited by using the zero-ohm chip resistor 23 since, in the zero-ohm chip resistor 23, the resistance value thereof is fairly close to zero, the resistance component at the point can be fairly small. Accordingly, h is possible to prevent the resonance characteristics of the inverted F-type antenna from deteriorating due to a resistance component Therefore, the characteristics of the antenna can be kept satisfactory.

On the other hand, by changing a combination of the connection terminals 31*a*1, 31*a*2 and 31*a*3 and connection terminals 31*b*1, 31*b*2 and 31*b*3, to which the zero-ohm chip resistor 23 is connected, it is possible to vary the electric length from the feeding point 22 to the connection portion at which the ground electrode 24*b* is connected to the zero-ohm chip resistor 23.

Figure 2B:
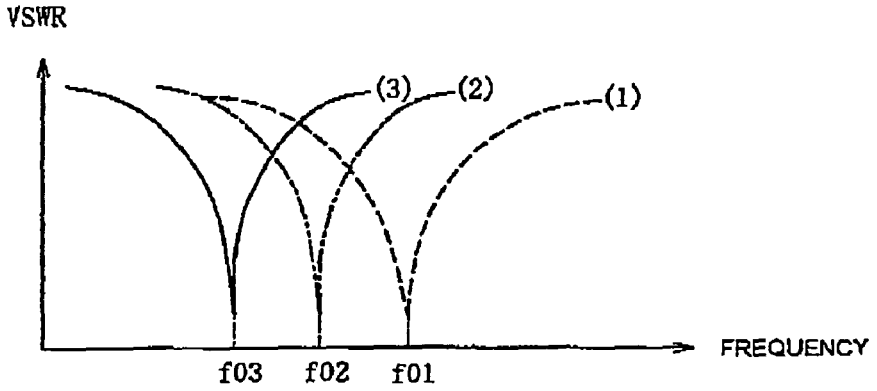
FIG. 2B is a schematic view schematically showing the frequency characteristics of a voltage standing wave ratio (VSWR) in an antenna formed on the circuit board.

Referring to FIG. 2B, the resonance characteristics of an antenna formed on the circuit board 17 will be described. FIG. 2B is a schematic view showing the frequency characteristics of a voltage standing wave ratio (VSWR) of the antenna formed on the circuit board 17.

The VSWR expresses a ratio (|V2|/|V1|) of the maximum value (|V2|) to the minimum value (|V1|) of standing waves occurring in the radiation line 21. If the radiation line 21 resonates, the difference between the minimum value (|V1|) and the maximum value (|V2|) of the standing waves becomes smaller than that in a case in which the radiation line 21 does not resonate. Therefore, the frequency at which the VSWR in FIG. 2B becomes the least value becomes a resonance frequency.

In FIG. 2B, (1) shows the frequency characteristics of the VSWR where the zero-ohm chip resistor 23 is connected in a combination of the connection terminal 31*a*1 and the connection terminal 31*b*1, (2) shows the frequency characteristics of the VSWR where the zero-ohm chip resistor 23 is connected in a combination of the connection terminal 31*a*2 and the connection terminal 31*b*2, and (3) shows the frequency characteristics of the VSWR where the zero-ohm chip resistor 23 is connected in a combination of the connection terminal 31*a*3 and the connection terminal 31*b*3.

As described above, it is known that, if the electric length from the feeding point 22 to the connection portion where the ground electrode 24*b* and the zero-ohm chip resistor 23 are connected varies, the resonance frequency of the antenna varies. That is, as the electric length from the feeding point 22 to the connection portion where the ground electrode 24*b* and the zero-ohm chip resistor 23 are connected becomes shorter, the resonance frequency of an inverted F-type antenna becomes lower.

Therefore, in a case where the zero-ohm chip resistor 23 is connected in a combination of the connection terminal 31*a*1 and the connection terminal 31*b*1, the electric length from the feeding point 22 to the connection portion (connection terminal 31*b*1) where the ground electrode 24*b* and the zero-ohm chip resistor 23 are connected is the longest, the resonance frequency f01 becomes highest as shown in (1) of FIG. 2B.

Also, in a case where the zero-ohm chip resistor 23 is connected in a combination of the connection terminal 31*a*2 and the connection terminal 31*b*2, the electric length from the feeding point 22 to the connection portion (connection terminal 31*b*2) where the ground electrode 24*b* and the zero-ohm chip resistor 23 are connected is shorter than in the case of (1) in FIG. 2B, the resonance frequency f02 thereof becomes lower than the resonance frequency f01 as shown in (2) of FIG. 2B.

Further, in a case where the zero-ohm chip resistor 23 is connected in a combination of the connection terminal 31*a*3 and the connection terminal 31*b*3, the electric length from the feeding point 22 to the connection portion (connection terminal 31*b*3) where the ground electrode 24*b* and the zero-ohm chip resistor 23 are connected is shortest, the resonance frequency f03 thereof becomes lowest as shown in (3) of FIG. 2B.

Thus, an antenna showing a desired resonance frequency can be obtained on the circuit board 17 by selecting the position, where the zero-ohm chip resistor 23 is connected to the short-circuit line 29, from among the connection terminals 31*a*1, 31*a*2, and 31*a*3 in the circuit board 17. Also, the zero ohm chip resistor 23 is mounted on the circuit board 17 after forming an antenna on the circuit board 17 by a conductor pattern, and the connection position of the zero-ohm chip resistor 23 at the short-circuit line 29 side can be changed in plural stages thereafter. Therefore, the antenna characteristics can be adjusted in plural stages after the antenna is formed on the circuit board 17.

Further, in a case where a dielectric substrate 20 having a different dielectric constant is used as the dielectric substrate 20 of the circuit board 17, it is possible to match the characteristics of an antenna formed on respective circuit boards 17 by selecting the position, where the zero-ohm chip resistor 23 is connected to the short-circuit line 29, from among the connection terminals 31*a*1, 31*a*2, and 31*a*3 on the respective circuit boards 17.

Figure 3A:
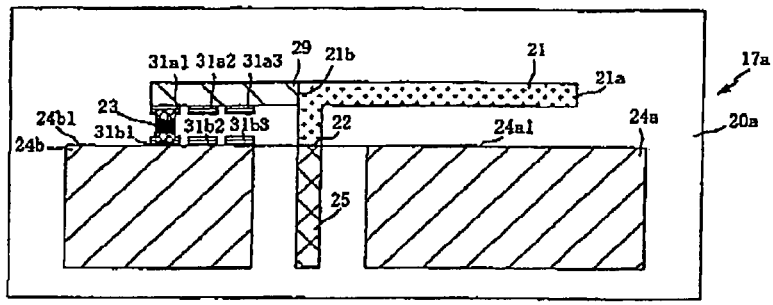
FIG. 3A is a schematic view showing a configuration of an antenna formed on a circuit board using a dielectric substrate having one dielectric constant.
Figure 3B:
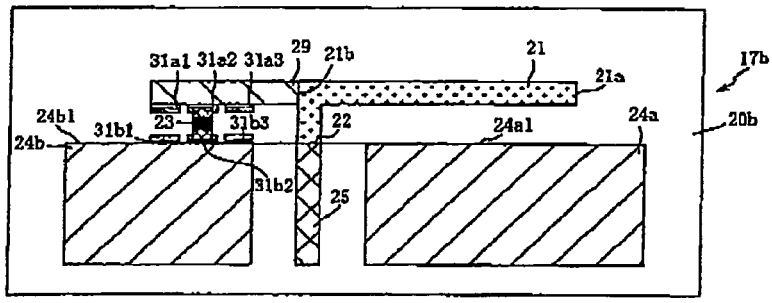
FIG. 3B is a schematic view showing a configuration of an antenna formed on a circuit board using a dielectric substrate having a higher dielectric constant than that of the dielectric substrate shown in FIG. 3A.
Figure 3C:
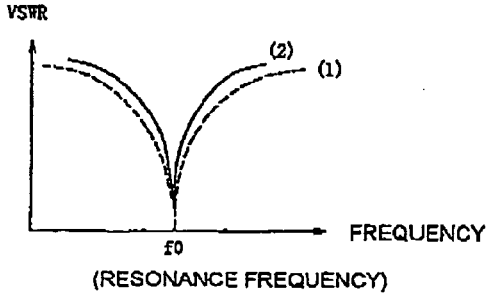
FIG. 3C is a schematic view showing the frequency characteristics of VSWR in respective antennas formed on the circuit board shown in FIG. 3A and the circuit board shown in FIG. 3B.

Referring to FIG. 3A through FIG. 3C, the principle for matching the characteristics of respective antennas formed on circuit boards 17*a* and 17*b* equipped with dielectric substrates 20*a* and 20*b* having different dielectric constants in the first exemplary embodiment will be described. FIG. 3A is a schematic view showing a configuration of an antenna formed on the circuit board 17*a* using a dielectric substrate 20*a* having one dielectric constant, FIG. 3B is a schematic view showing a configuration of an antenna formed on the circuit board 17*b* using a dielectric substrate 20*b* having a higher dielectric constant than that of the dielectric substrate 20*a* shown in FIG. 3A.

FIG. 3C is a schematic view showing the frequency characteristics of VSWR at antennas formed on the circuit board 17*a* shown in FIG. 3A and the circuit board 17*b* shown in FIG. 3B. In FIG. 3C, (1) shows the frequency characteristics of VSWR at the circuit board 17*a* shown in FIG. 3A and (2) shows the frequency characteristics of VSWR at the circuit board 17*b* shown in FIG. 3B.

As shown in FIG. 3A and FIG. 3B, on the circuit board 17*a* using the dielectric substrate 20*a* and the circuit board 17*b* using the dielectric substrate 20*b*, the ground electrodes 24*a*, 24*b*, radiation line 21, feeding line 25, short-circuit line 29, connection terminals 31*a*1, 31*a*2 and 31*a*3 and connection terminals 31*b*1, 31*b*2 and 31*b*3 are formed with the same conductor pattern, respectively.

Herein, in the circuit board 17*a* using the dielectric substrate 20*a*, the zero-ohm chip resistor 23 is connected in combination of the connection terminal 31*a*1 and the connection terminal 31*b*1 as shown in FIG. 3A. The resonance frequency of the antenna formed on the circuit board 17*a* is adjusted to become f0 as shown in (1) of FIG. 3C.

On the other hand, since in the circuit board 17*b* using the dielectric substrate 20*b*, the dielectric constant of the dielectric substrate 20*b* is higher than that of the dielectric substrate 20*a*, the resonance frequency of the antenna formed on the circuit board 17*b* using the dielectric substrate 20*b* becomes higher than the resonance frequency f0 of the antenna formed on the circuit board 17*a* using the dielectric substrate 20*a* if the zero-ohm chip resistor 23 is connected in combination of the connection terminal 31*a*1 and the connection terminal 31*b*1.

On the contrary, as shown in FIG. 3B, if the zero-ohm chip resistor 23 is connected in combination of the connection terminal 31*a*2 and the connection terminal 31*b*2, the resonance frequency of the antenna becomes lower than in the case where the zero-ohm chip resistor 23 is connected in combination of the connection terminal 31*a*1 and the connection terminal 31*b*1. Therefore, influences on the resonance frequency by the dielectric constant are counterbalanced by influences on the resonance frequency by the position where the zero-ohm resistor 23 is connected to the short-circuit line 29.

Therefore, as shown in FIG. 3B, if the zero-ohm chip resistor 23 is connected in combination of the connection terminal 31*a*2 and the connection terminals 31*b*2 in the circuit board 17*b* using the dielectric substrate 20*b*, the resonance frequency of the antenna formed on the circuit board 17*b* can be adjusted to f0 as shown in (2) of FIG. 3C.

Thus, in the circuit boards 17*a* and 17*b* using dielectric substrates 20*a* and 20*b* having different dielectric constants, the resonance frequencies of antennas formed on the respective circuit boards 17 can be matched to each other by selecting the position, at which the zero-ohm chip resistor 23 is connected to the radiation line 21, even if the ground electrodes 24*a*, 24*b*, radiation line 21, feeding line 25, and short-circuit line 29 are formed using the same conductor pattern.

As described above, with the circuit board 17 and MFP 1 according to the first exemplary embodiment, after the ground electrodes 24*a*, 24*b*, radiation line 21, feeding line 25, and short-circuit line 29 are formed by a conductor pattern to form an antenna, the zero-ohm chip resistor 23 is mounted to short-circuit the radiation line 21 and the ground electrode 24*b*. Here, since the short-circuit line 29 is provided with a plurality of connection terminals 31*a*1, 31*a*2 and 31*a*3 to connect one end of the zero-ohm chip resistor 23 to the short-circuit line 29, the position where one end of the zero-ohm chip resistor 23 is connected to the short-circuit line 29 can be selected from among the connection terminals 31*a*1, 31*a*2 and 31*a*3. Therefore, since the electric length from the feeding point 22 to the connection portion of the ground electrode 24*b* to the zero-ohm chip resistor 23 can be varied in plural stages, the resonance frequency of the antenna formed on the circuit board 17 can be changed in plural stages. Accordingly, the characteristics of an antenna can be adjusted after the antenna is formed on the circuit board 17.

Further, in a case where an antenna is formed on each of the circuit boards 17*a* and 17*b* using the dielectric substrates 20*a* and 20*b* having different dielectric constants, and even in a case where the ground electrode 24*a* and 24*b*, radiation line 21, feeding line 25 and short-circuit line 29 are formed by using the same conductor pattern, the antenna formed on the circuit board 17 can be matched to desired characteristics if the connection position of the zero-ohm chip resistor 23 at the short-circuit line 29 side is changed according to the dielectric constant Therefore, it is possible to save work for designing the antenna in compliance with the dielectric constant of the dielectric substrates 20*a* and 20*b*.

Second Exemplary Embodiment

Figure 4A:
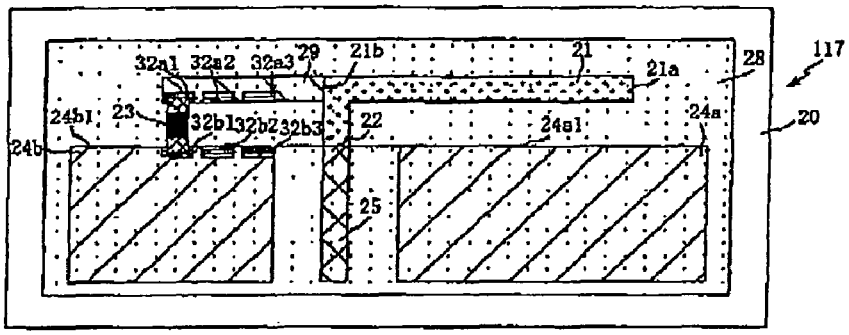
FIG. 4A is a schematic view showing a configuration of an antenna formed on a circuit board according to a second exemplary embodiment.

Referring to FIG. 4A, a second exemplary embodiment of the present invention will be described. In the first exemplary embodiment described above, a description was given of the case where the connection terminals 31*a*1, 31*a*2 and 31*a*3 and the connection terminals 31*b*1, 31*b*2 and 31*b*3 are formed of lands on the circuit board 17. However, in the second exemplary embodiment, the connection terminals 32*a*1, 32*a*2 and 32*a*3 and the connection terminals 32*b*1, 32*b*2 and 32*b*3 are formed on the circuit board 117 by removing a part of solder resist 28 that coats the short-circuit line 29 and the ground electrode 24*b* (that is, resist removing).

Also, in the second exemplary embodiment, a description is based on the assumption that the circuit board 117 carries out a cordless communication function by which telephone calls are executed with a cordless handset 61 via wireless communications and is internally incorporated in the MFP 1. Parts that are identical to those of the first exemplary embodiment are given the same reference numerals, and the description thereof will be omitted.

FIG. 4A is a schematic view showing a configuration of an antenna formed on the circuit board 117 according to the second exemplary embodiment. In this second exemplary embodiment, the upper surface and sides of the ground electrodes 24*a*, 24*b*, the radiation line 21, the feeding line 25 and the short-circuit line 29 formed on the dielectric substrate 20 are coated with a solder resist 28 that is an insulative film.

And, the solder resist 28 that coats the upper surface of the ground electrode 24*b* is removed at a plurality of points (three points in the second exemplary embodiment) so as to be opposed to the short-circuit line 29 with a predetermined space, and the upper surface of the ground electrode 24*b* is exposed, whereby the connection terminals 32*b*1, 32*b*2 and 32*b*3 are formed.

One end of the zero-ohm chip resistor 23 is connected to the connection terminals 32*b*1, 32*b*2 and 32*b*3. And, by connecting one end of the zero-ohm chip resistor 23 to any one of the connection terminals 32*b*1, 32*b*2 and 32*b*3, the zero-ohm chip resistor 23 is electrically connected to the ground electrode 24*b*.

In addition, of the solder resist 28 that coats the upper surface of the short-circuit line 29, the solder resist 28 is removed, at a plurality of points (three points in the second exemplary embodiment) at the position apart from the connection position 21*b* of the short-circuit line 29 with the radiation electrode 21 so as to be opposed to the respective connection terminals 32*b*1, 32*b*2 and 32*b*3 formed on the ground electrode 24*b* with a space of a predetermined distance (that is, the length according to the size of the zero-ohm chip resistor 23), and the upper surface of the short-circuit line 29 is exposed to form the connection terminals 32*a*1, 32*a*2 and 32*a*3.

One end of the zero-ohm chip resistor 23 is connected to the connection terminals 32*a*1, 32*a*2 and 32*a*3. And, the other end of the zero-ohm chip resistor 23 is connected to the connection terminals 32*b*1, 32*b*2 and 32*b*3 provided at the ground electrode 24*b* while one end of the zero-ohm chip resistor 23 is connected to any one of the connection terminals 32*a*1, 32*a*2 and 32*a*3, whereby the zero-ohm chip resistor 23 is electrically connected to the short-circuit line 29.

The zero-ohm chip resistor 23 is configured to be mounted on the circuit board 117 so that one end thereof is connected to the connection terminal 32*a*1 while the other end thereof is connected to the connection terminal 32*b*1, one end thereof is connected to the connection terminal 32*a*2 while the other end thereof is connected to the connection terminal 32*b*2, or one end thereof is connected to the connection terminal 32*a*3 while the other end thereof is connected to the connection terminal 32*b*3. That is, it becomes possible to select the connection position of the zero-ohm resistor 23.

As described above, according to the second exemplary embodiment, as in the first exemplary embodiment, since the connection position of the zero-ohm chip resistor 23 in the short-circuit line 29 can be selected, the characteristics of an antenna can be adjusted after the antenna is formed on the circuit board 117. Also, the antenna formed on the circuit board 117 can be matched to desired characteristics. Therefore, it is possible to save work for designing the antenna in compliance with the dielectric constant of the dielectric substrate 20. In addition, since the connection terminals 32*a*1, 32*a*2 and 32*a*3 are formed by removing the spider resist 28 so that the short-circuit line 29 is exposed, it is possible to prevent the shape of the short-circuit line 29 from being deformed by the connection terminals and to prevent the characteristics of the antenna from deteriorating as in the case where the connection terminals 31*a*1, 31*a*2 and 31*a*3 are formed as, for example, lands. Accordingly, it is possible to favorably keep the characteristics of the antenna.

Third Exemplary Embodiment

Next, referring FIG. 4B, a third exemplary embodiment of the present invention will be described. In the circuit board 17 according to the first exemplary embodiment described above, although a description was given of a case where the short-circuit line 29 and the ground electrode 24*b* are short circuited by the zero-ohm chip resistor 23, the short-circuit line 29 and the ground electrode 24*b* are short-circuited by a jumper line 26 in the circuit board 217 according to the third exemplary embodiment. In the circuit board 217 according to the third exemplary embodiment, holes 33*b*1, 33*b*2 and 33*b*3 are formed on the ground electrode 24 as connection terminals, into which the jumper line 26 is fitted, and holes 33*a*1, 33*a*2 and 33*a*3 are formed on the short-circuit line 29 as connection terminals, into which a jumper line 26 is fitted.

In the third exemplary embodiment, a description is based on the assumption that the circuit board 217 carries out a cordless communication function by which telephone calls are executed with a cordless handset 61 via wireless communications and is internally incorporated in the MFP 1. Parts that are identical to those of the first exemplary embodiment are given the same reference numerals, and the description thereof will be omitted.

Figure 4B:
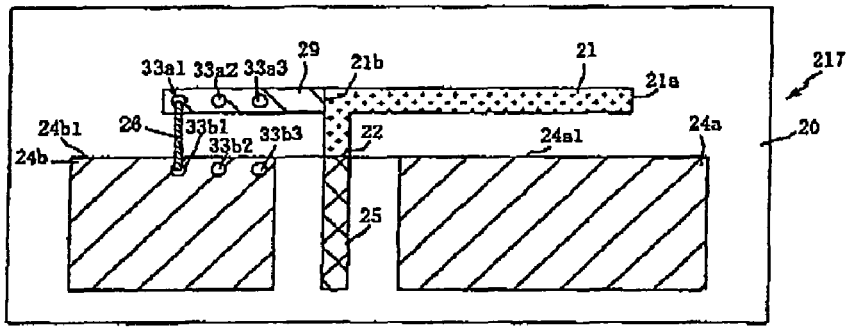
FIG. 4B is a schematic view showing a configuration of an antenna formed on a circuit board according to a third exemplary embodiment.

FIG. 4B is a schematic view showing a configuration of an antenna formed on the circuit board 217 according to the third exemplary embodiment In the third exemplary embodiment, a plurality of holes (three holes in the third exemplary embodiment) are formed, as connection terminals 33*b*1, 33*b*2 and 33*b*3, respectively, on the ground electrode 24*b* so as to be opposed to the short-circuit line 29 with a predetermined distance apart therefrom.

One end of jumper line 26 is capable of being fitted in the connection terminals 33*b*1, 33*b*2 and 33*b*3 and connected thereto. By fitting one end of the jumper line 26 into any one of the connection terminals 33*b*1, 33*b*2 and 33*b*3 for connection, the jumper line 26 is electrically connected to the ground electrode 24*b*.

A plurality of holes (three holes in the third exemplary embodiment) are formed, as the connection terminals 33*a*1, 33*a*2 and 33*a*3, at the position apart from the connection position 21*b* of the short-circuit line 29 with the radiation electrode 21 so as to be opposed to the connection terminals 33*b*1, 33*b*2 and 33*b*3 formed at the ground electrode 24*b* with a predetermined distance apart therefrom.

The other end of the jumper line 26 is capable of being fitted in the connection terminals 33*a*1, 33*a*2 and 33*a*3 and connected therein. By fitting the other end, which is different from one end of the jumper line 26 connected to the connection terminals 33*b*1, 33*b*2 and 33*b*3 provided at the ground electrode 24*b*, to any one of the connection terminals 33*a*1, 33*a*2 and 33*a*3 for connection, the jumper line 26 is electrically connected to the short-circuit line 29.

The jumper line 26 is an electric wire formed of a single conductor, and functions as a jumper element by which two points on the circuit are short-circuited as in the zero-ohm chip resistor 23. The jumper line 26 is mounted on the circuit board 217 after the ground electrode 24*a*, 24*b*, radiation line 21, feeding line 25, and short-circuit line 29 are formed as a conductor pattern on the circuit board 217 and the connection terminals 31*a*1, 31*a*2 and 31*a*3 and 31*b*1, 31*b*2 and 31*b*3 are formed in the short-circuit line 29 and the ground electrode 24*b* by making a hole by means of a drill.

At this time, the jumper line 26 is configured to be mounted on the circuit board 217 so that one end thereof is connected to the connection terminal 33*a*1 while the other end thereof is connected to the connection terminal 33*b*1, one end thereof is connected to the connection terminal 33*a*2 while the other end thereof is connected to the connection terminal 33*b*2, or one end thereof is connected to the connection terminal 33*a*3 while the other end thereof is connected to the connection terminal 33*b*3. That is, it becomes possible to select the connection position of the jumper line 26.

As described above, according to the third exemplary embodiment, since the connection position of the zero-ohm chip resistor 23 at the short-circuit line 29 can be selected as in the first exemplary embodiment, the characteristics of an antenna can be adjusted after the antenna is formed on the circuit board 217. Also, since the antenna formed on the circuit board 217 can be matched to desired characteristics, it is possible to save work for designing the antenna in compliance with the dielectric constant of the dielectric substrate 20. In addition, since holes into which the jumper lines 26 are fitted are formed on the short-circuit line 29 as the connection terminals 33*a*1, 33*a*2 and 33*a*3, the connection terminals 33*a*1, 33*a*2 and 33*a*3 can be easily formed. Also, since the connection position of one end of the jumper line 26 can be clearly identified by existence of the holes, it is possible to easily carry out the positioning where the jumper line 26 is fitted into the connection terminals 33*a*1, 33*a*2 and 33*a*3 by a chip mounter.

Further, since the short-circuit line 29 and the ground electrode 24*b* are short-circuited by the jumper line 26, both of the connection terminals 33*a*1, 33*a*2 and 33*a*3 and the connection terminals 33*b*1, 33*b*2 and 33*b*3 can be easily connected by the jumper line 26 even if the distance between the connection terminals 33*a*1, 33*a*2 and 33*a*3 and the connection terminals 33*b*1, 33*b*2 and 33*b*3 is an optional length as compared with a case where the zero-ohm chip resistor 23, the size of which is fixed, is used.

Fourth Exemplary Embodiment

Next, referring to FIG. 4C, a fourth exemplary embodiment of the present invention will be described. In the circuit board 17 according to the first exemplary embodiment, a description was given of a case where a plurality (three in the first exemplary embodiment) of connection terminals 31*a*1, 31*a*2 and 31*a*3 and connection terminals 31*b*1, 31*b*2 and 31*b*3 are formed in the short-circuit line 29 and the ground electrode 24*b*, respectively. However, the circuit board 317 according to the fourth exemplary embodiment is configured so that a single connection terminal 34*a* or 34*b* is formed in the short-circuit line 29 and the ground electrode 24*b*, respectively, and the connection position of the zero-ohm chip resistor 23 can be continuously changed in the respective connection terminals 34*a* and 34*b*.

In the fourth exemplary embodiment, a description is based on the assumption that the circuit board 317 provides a cordless communication function by which telephone calls are executed with the cordless handset 61 via wireless communications, and is internally incorporated in the MFP 1. Also, parts that are identical to those of the first exemplary embodiment are given the same reference numerals, and the description thereof will be omitted.

Figure 4C:
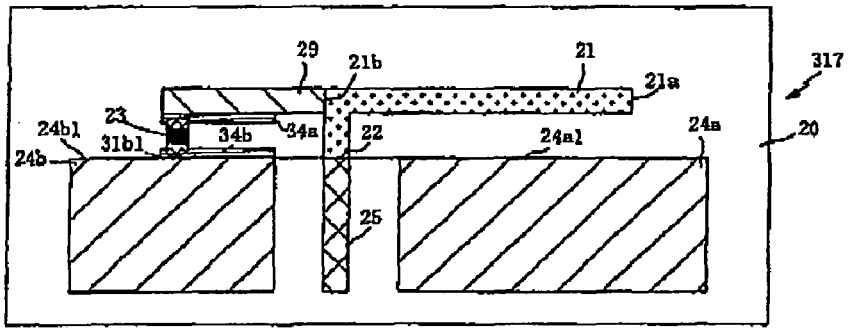
FIG. 4C is a schematic view showing a configuration of an antenna formed on a circuit board according to a fourth exemplary embodiment.

FIG. 4C is a schematic view showing a configuration of an antenna formed on the circuit board 317 according to the fourth exemplary embodiment In the fourth exemplary embodiment, a single connection terminal 34*b* is formed in the ground electrode 24*b* so that it is opposed to the short-circuit line 29 with a predetermined distance. The connection terminal 34*b* is composed of lands formed by patterning a conductor so as to be brought into contact with the outer edge of the ground electrode 24*b*. In the connection terminal 34*b*, the length of a side opposed to the short-circuit line 29 is formed to be longer than a width necessary to connect the electrodes of the zero-ohm chip resistor 23. Accordingly, it is possible to connect one end of the zero-ohm chip resistor 23 to any position of the connection terminal 34*b*.

On the other hand, the connection terminal 34*a* is formed at a position apart from the connection position 21*b* of the short-circuit line 29 to the radiation electrode 21*b* so as to be spaced by a predetermined distance (a length corresponding to the size of the zero-ohm chip resistor 23) from and opposed to the connection terminal 34*b*1 formed on the ground electrode 24*b*. The connection terminal 34*a* is composed of lands formed by patterning a conductor so as to be brought into contact with the outer edge of the short-circuit line 29. Further, as in the connection terminal 34*b*, the length of a side opposed to the ground electrode 24*b* at the connection terminal 34*a* is formed so as to become longer than the width necessary to connect the electrodes of the zero-ohm chip resistor 23. Accordingly, it becomes possible to connect the other end of the zero-ohm chip resistor 23 to any position of the connection terminal 34*a*.

And, after an antenna is composed by forming the ground electrodes 24*a*, 24*b*, the radiation line 21, the feeding line 25, the short-circuit line 29, the connection terminal 34*a* and the connection terminal 34*b* by patterning a conductor on the circuit board 317, one end of the zero-ohm chip resistor 23 is connected to a desired position of the connection terminal 34*a* and the other end thereof is connected to a desired position of the connection terminal 34*b* so that the resonance frequency of the antenna becomes a predetermined frequency. In addition, by optionally (continuously) changing the position, at which the zero-ohm chip resistor 23 is connected to the short-circuit line 29, on the connection terminal 34*a*, it is possible to minutely adjust the resonance frequency of the antenna formed on the circuit board 317.

As described above, according to the fourth exemplary embodiment since the connection position of the zero-ohm chip resistor 23 on the short-circuit line 29 can be selected, the characteristics of an antenna can be adjusted after the antenna is formed on the circuit board 317 as in the first exemplary embodiment. Also, the antenna formed on the circuit board 317 can be matched to desired characteristics. Therefore, it is possible to save work for designing the antenna in compliance with the dielectric constant of the dielectric substrates 20. In addition, since the connection terminal 34*a* at the short-circuit line 29 side is configured so as to optionally (continuously) change the position where the zero-ohm chip resistor 23 is connected, the resonance frequency of the antenna formed on the circuit board 317 can be minutely adjusted by optionally (continuously) changing the connection position of the zero-ohm chip resistor 23 to the short-circuit line 29.

Fifth Exemplary Embodiment

Next, referring to FIG. 5, a fifth exemplary embodiment of the present invention will be described. In the circuit board 17 according to the first exemplary embodiment a description was given of a case where the short-circuit line 29 is provided, the short-circuit line 29 and the ground electrode 24*b* are short-circuited by means of a zero-ohm chip resistor 23, and the connection position of the zero-ohm chip resistor 23 at the short-circuit line 29 is configured so as to be changeable. However, in the circuit board 417 according to the fifth exemplary embodiment the short-circuit line 29 is not provided, the radiation line 21 and the ground electrode 24*b* are short-circuited by means of a zero-ohm chip resistor 23, and the connection position of the zero-ohm chip resistor 23 at the radiation line 21 is configured so as to be changeable.

In the fifth exemplary embodiment a description is based on the assumption that the circuit board 417 provides a cordless communication function by which telephone calls are executed with the cordless handset 61 via wireless communications, and is internally incorporated in the MFP 1. Also, parts that are identical to those of the first exemplary embodiment are given the same reference numerals, and the description thereof will be omitted.

Figure 5:
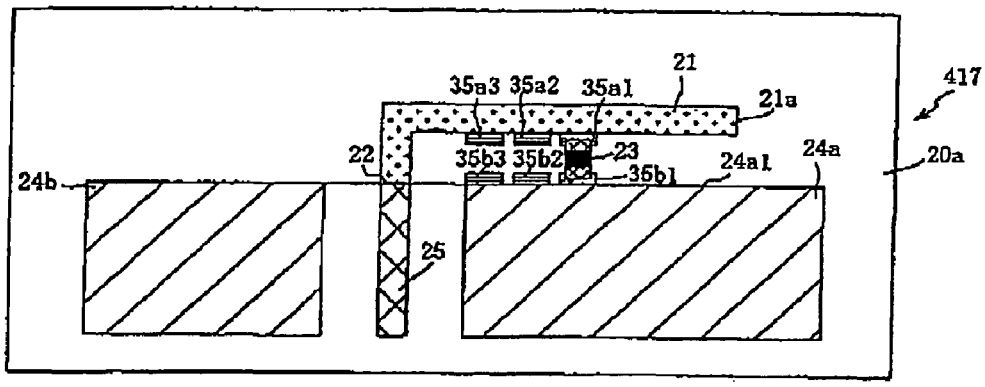
FIG. 5 is a schematic view showing a configuration of an antenna formed on a circuit board according to a fifth exemplary embodiment.

FIG. 5 is a schematic view showing a configuration of an antenna formed on the circuit board 417 according to the fifth exemplary embodiment. In the fifth exemplary embodiment, a plurality (three in the fifth exemplary embodiment) of connection terminals 35*b*1, 35*b*2 and 35*b*3 are formed so as to be spaced by a predetermined distance from and to be opposed to the radiation line 21 on the ground electrode 24*a*. The connection terminals 35*b*1, 35*b*2 and 35*b*3 are composed of lands formed by patterning a conductor so as to be brought into contact with the outer edge of the ground electrode 24*a*. Therefore, when one end of the zero-ohm chip resistor 23 is connected by a chip mounter, the connection terminals 35*b*1, 35*b*2 and 35*b*3 can be used as marks of the connection positions of the zero-ohm chip resistor 23.

One end of the zero-ohm chip resistor 23 is connected to the connection terminals 35*b*1, 35*b*2 and 35*b*3. And, by connecting the one end of the zero-ohm resistor 23 to any one of the connection terminals 35*b*1, 35*b*2 and 35*b*3, the zero-ohm chip resistor 23 is electrically connected to the ground electrode 24*a*.

On the other hand, in the radiation line 21, a plurality (three in the fifth exemplary embodiment) of connection terminals 35*a*1, 35*a*2 and 35*a*3 are formed so as to be spaced by a predetermined distance (length according to the size of zero-ohm chip resistor 23) from and to be opposed to the connection terminals 35*b*1, 35*a*2 and 35*b*3 formed on the ground electrode 24*a*. The connection terminals 35*a*1, 35*a*2 and 35*a*3 are composed of lands formed by patterning a conductor so as to be brought into contact with the outer edge of the radiation line 21. Therefore, when one end of the zero-ohm chip resistor 23 is connected by the chip mounter, the connection terminals 35*a*1, 35*a*2 and 35*a*3 can be used as the marks of the connection position of the zero-ohm chip resistor 23.

One end of the zero-ohm chip resistor 23 is capable of being connected to the connection terminals 35*a*1, 35*a*2 and 35*a*3. By connecting another end, which is different from one of the zero-ohm chip resistor 23 connected to the connection terminal 35*b*1, 35*b*2 and 35*b*3 provided at the ground electrode 24*a*, to any one of the connection terminals 35*a*1, 35*a*2 and 35*a*3, the zero-ohm chip resistor 23 is electrically connected to the radiation line 29, and the radiation line 21 is short-circuited to the ground electrode 24*a*.

According to the above configuration, since an inductance component is generated between the radiation line 21 and the ground electrode 24*a*, a parasitic capacitance (reactance component) occurring at the portion where the radiation line 21 is opposed to the ground electrode 24*a* is cancelled. Accordingly, the resonance characteristics of the antenna formed on the circuit board 417 can be improved.

Further, the zero-ohm chip resistor 23 is configured to be mounted on the circuit board 417 so that one end thereof is connected to the connection terminal 35*a*1 while the other end thereof is connected to the connection terminal 35*a*1, one end thereof is connected to the connection terminal 35*a*2 while the other end thereof is connected to the connection terminal 35*a*2, or one end thereof is connected to the connection terminal 35*a*3 while the other end thereof is connected to the connection terminal 35*b*3. That is, the connection position of the zero-ohm chip resistor 23 can be selected.

As described above, according to the fifth exemplary embodiment, the radiation line 21 and the ground electrode 24*a* can be short-circuited with a zero-ohm chip resistor 23 mounted after an antenna is composed by forming the ground electrode 24*a*, 24*b*, the radiation line 21, and the feeding line 25 on the dielectric substrate 20 by a conductor pattern. Here, since a plurality of connection terminals 35*a*1, 35*a*2 and 35*a*3 to connect one end of the zero-ohm chip resistor 23 to the radiation line 21 are provided on the radiation line 21, it is possible to select the position, at which one end of the zero-ohm chip resistor 23 is connected to the radiation line 21, from among the connection terminals 35*a*1, 35*a*2 and 35*a*3. Therefore, since the electric length from the feeding point 22 to the connection portion of the ground electrode 24*a* to the zero-ohm chip resistor 23 can be changed in plural stages, the resonance frequency of the antenna formed on the circuit board 417 can be changed in plural stages. Therefore, the characteristics of the antenna can be adjusted after the antenna is formed on the circuit board 417.

Also, in a case where an antenna is formed on a circuit board using dielectric substrates having different dielectric constants, the antenna formed on the circuit board 417 can have desired characteristics by changing the connection position of the zero-ohm chip resistor 23 at the radiation line 21 side according to the dielectric constant based on the same principle according to the first exemplary embodiment Accordingly, it is possible to save work for designing the antenna in compliance with the dielectric constant of the dielectric substrate.

While the present invention has been shown and described with reference to certain exemplary embodiments thereof, it will be understood by those skilled in the art that various changes in form and details may be made therein without departing from the spirit and scope of the invention as defined by the appended claims.

For example, in the first to fourth exemplary embodiments, a description was given of cases where the radiation line 21 and the ground electrodes 24*a*, 24*b* are formed on the same surface of the dielectric substrate 20. However, the exemplary embodiments are not necessarily limited thereto. The radiation line may be formed on one surface of the dielectric substrate 20, and the ground electrode may be formed on another surface of the dielectric substrate 20, which is opposed to the one surface. In this case, the short-circuit lines and the connection terminals provided at the short-circuit line are formed on the other surface that is the same as that of the ground electrode, and the radiation line and the short-circuit line may be connected to each other via through holes formed in the dielectric substrate 20. Alternatively, the connection terminal provided on the ground electrode may be formed on the same surface as that of the radiation line, and the connection terminals and the ground electrode may be connected to each other via through holes formed in the dielectric substrate 20.

Also, in the fifth exemplary embodiment, similarly, the radiation line may be formed on one surface of the dielectric substrate 20, and the ground electrode may be formed on another surface of the dielectric substrate 20, which is opposed to the one surface. In this case, for example, the connection terminals for the ground electrode may be formed on the same surface as that of the radiation line, and the connection terminals for the ground electrode may be connected to the ground electrode via the through holes formed in the dielectric substrate 20. On the contrary, the connection terminals for the radiation line may be formed on another surface that is the same as the ground electrode, and the connection terminals for the radiation line may be connected to the radiation line via the through holes formed in the dielectric substrate 20.

Also, in the first to third and fifth exemplary embodiments, a description was given of a case where the connection terminals (31*b*1, 31*b*2 and 31*b*3) formed on the ground electrode 24*b* are formed by the same number as that of the connection terminals (31*a*1, 31*a*2 and 31*a*3) formed on the short-circuit line 29 or the radiation line 21. However, the number is not necessarily limited thereto. The connection terminals (31*b*1, 31*b*1 and 31*b*3) formed on the ground electrode 24*b* may be less than the number of the connection terminals (31*a*1, 31*a*2 and 31*a*3) formed on the short-circuit line 29 or the radiation line 21. In this case, the connection terminals (31*b*1, 31*b*2 and 31*b*3) of the ground electrode 24*b*, which connects the ends thereof, may be selected according to the size of the zero-ohm chip resistor 23 or the jumper line 26.

In addition, in the fourth exemplary embodiment the length of a side opposed to the short-circuit line 29 of the connection terminal 31*b*1 formed on the ground electrode 24*b* may be made shorter than the length of a side opposed to the ground electrode 24*b* of the connection terminal 31*a*1 formed on the short-circuit line 29. In this case, the connection position of the zero-ohm chip resistor 23 at the connection terminal 34*b* may be selected according to the size of the zero-ohm chip resistor 23.

Also, in the second exemplary embodiment a description was given of a case where the solder resist 28 that coats the upper surface of the short-circuit line 29 is stripped at plural spots and the short-circuit line 29 is exposed. However, the second exemplary embodiment is not necessarily limited thereto. The solder resist 28 may be stripped at a single spot, and the stripping length may be made longer than the width necessary to connect the electrode of the zero-ohm chip resistor 23. Therefore, it becomes possible for the zero-ohm chip resistor 23 to be connected to any optional position of the connection terminal. Further, in this case, in regard to the connection terminals formed at the ground electrode 24*b*, the solder resist 28 is stripped at a single spot, and the stripping length thereof may be made longer than the width necessary to connect the electrode of the zero-ohm chip resistor 23 in compliance with the connection terminal on the short-circuit line 29.

In addition, in the third exemplary embodiment, although a plurality of holes for fitting the jumper line 26 in the short-circuit line 29 are formed as the connection terminals, the plurality of holes may be formed so as to be linked with each other, or may be formed as a single groove. Therefore, it is possible to minutely set the connection positions of the jumper line 26. Also, in this case, the connection terminals of the ground electrode 24*b* may be formed by linking a plurality of holes with each other in compliance with the connection terminals formed on the short-circuit line 29, or may be formed as a single groove.

Also, in the fifth exemplary embodiment, a description was given of a case where the connection terminals are formed by a plurality of lands in the radiation line 21. However, the fifth exemplary embodiment is not necessarily limited thereto, the solder resist that coats the upper surface of the radiation line 21 is stripped at a plurality of spots, and the connection terminals may be formed by exposing the radiation lines 21. Therefore, it is possible to prevent the antenna from deteriorating due to deformation of the radiation line by forming the connection terminals. In addition, the connection terminals may be formed by a plurality of holes into which the short-circuit elements are fitted. Accordingly, the connection terminals may be easily formed, and the connection positions may be clearly identified by existence of the holes. Therefore, where the connection terminals of the radiation line 21 are formed of lands, a single land is formed, and the length of a side of the land, which is opposed to the ground electrode 24*a*, may be formed so as to become longer than the width necessary to connect the short-circuit element Also, where the connection terminals of the radiation line 21 are formed by stripping the solder resist and exposing the radiation line 21, the solder resist is stripped at a single spot, and the stripping length may be made longer than the width necessary to connect the short-circuit element. Further, where the connection terminals of the radiation line 21 are formed by holes into which the short-circuit element is fitted, a plurality of holes may be formed so as to be linked together or may be formed as a single groove. Therefore, since positions that can be connected at one end of the short-circuit element can be formed to be continuous, the characteristics of the antenna can be minutely adjusted. In addition, the shape of the connection terminals of the ground electrode 24 may be formed to the shape of the connection terminals formed on the radiation line 21.

Also, in the first, second, fourth and fifth exemplary embodiments described above, a description was given of a case where the zero-ohm chip resistor 23 is used as an element for short-circuiting the short-circuit line 29 and the ground electrode 24*b*, the exemplary embodiments are not necessarily limited thereto. An element the resistance component of which is almost zero Ω, for example, a zero-ohm resistor equipped with a jumper line and a lead line may be used. In the third exemplary embodiment, a description was given of a case where the jumper line 26 is used. However, the third exemplary embodiment is not necessarily limited thereto. A resistance element, the resistance component of which is zero Ω, having a lead line may be used. Further, in the respective exemplary embodiments, a short-circuit element may be formed by dropping solder between the connection terminals (31*a*, 31*a*2 and 31*a*3) of the radiation line 21 and the connection terminals (31*b*1, 31*b*2 and 31*b*3) of the ground electrode 24*b* instead of the zero-ohm chip resistor 23 and the jumper line 26.

In addition, in the first to fourth exemplary embodiments, a description was given of a case where the connection position 21*b* of the short circuit line 29 is the right angle portion of the radiation line 21. The exemplary embodiments are not necessarily limited thereto. The connection position 21*b* may be anywhere on the radiation line 21.

Also, in the respective exemplary embodiments, a description was given of a case where the short-circuit line 29 or the radiation line 21 are composed so that the position where the element (zero-ohm chip resistor 23 or jumper line 26) to short-circuit the short-circuit line 29 or the radiation line 21 to the ground electrode 24*b* is changeable. However, instead thereof or in addition thereto, a single connection terminal may be formed at the open end 21*a* of the radiation line 21, and one or more electrically independent connection terminals may be formed at the open end 21*a* side of the radiation line 21 and on the extension line of one side of the radiation line 21 including the open end 21*a*. Therefore, by connecting the zero-ohm chip resistor and the jumper line to the connection terminals formed on the open end 21*a* and to the connection terminal formed on the extension line and removing them therefrom, or by selecting the connection terminal to connect the zero-ohm chip resistor and the jumper line from a plurality of connection terminals formed on the extension line, the electric length of the radiation line 21 may be changed. Accordingly, the resonance frequency of the antenna can be adjusted. In addition, where antennas are formed on a circuit board by using dielectric substrates having different dielectric constants, the respective antennas can be matched to desired characteristics.

Also, in this case, the connection terminals may be formed of lands or may be formed by exposing (removing the resist) the conductor by stripping the solder resist. In addition, the connection terminals may be holes into which the jumper line and the lead line of a zero-ohm resistor element is fitted. Further, in this case, the short-circuit line 29 or the radiation line 21 and the ground electrode 24*b* may be short-circuited by a short-circuit line formed by patterning a conductor. Further, an L-shaped antenna in which the radiation line 21 and the ground electrode 24*b* are not short-circuited may be composed.

The present invention provides illustrative, non-limiting exemplary embodiments as follows:

(1) A circuit board includes: a dielectric substrate; a ground electrode formed on the dielectric substrate; a radiation line formed on the dielectric substrate, at least a part of the radiation line including em open end and opposed to the ground electrode; a feeding line connected to the other end of the radiation line, the feeding line configured to feed high frequency signals to the radiation line or receive high frequency signals generated in the radiation line; a short-circuit line formed on the dielectric substrate and connected to the radiation line; a short-circuit element configured to short-circuit the short-circuit line and the ground electrode; and a connection terminal provided on the short-circuit line, wherein the connection terminal connects one end of the short-circuit element to the short-circuit line at a connection position and is configured so that the connection position is changeable.

According to the above configuration, an antenna is formed on the circuit board. Since the radiation line and the ground electrode are short-circuited by the short-circuit line and short-circuit element, the parasitic capacitance (reactance component) occurring at the opposed portion of the radiation line and the ground electrode is cancelled by the inductance component of the short-circuit line and short-circuit element Therefore, the resonance characteristics of the antenna may be improved. Herein, since the short-circuit line is provided with a connection terminal by which a connection terminal that connects one end of the short-circuit element to the short-circuit line at a connection position and the connection terminal is configured so that the connection position is changeable, the connection position of the short-circuit element at the short-circuit line side can be changed after an antenna is formed on the circuit board. Accordingly, since the electric length from the other end of the radiation line, which is a connection portion of the radiation line with the feeding line, to the connection position of the short-circuit element with the ground electrode is changed if the connection position of the short-circuit element at the short-circuit line side is changed, the resonance frequency of the antenna formed on the circuit board can be changed Accordingly, such an effect by which the characteristics of the antenna can be adjusted after the antenna is formed is brought about In addition, where dielectric substrates having different dielectric constants are used, the antenna formed on the circuit board can be matched to desired characteristics if the connection position of the short-circuit element at the short-circuit line side is changed according to the dielectric constant. Therefore, such an effect can be brought about by which it is possible to save work for designing the antenna in compliance with the dielectric constant of the dielectric substrates.

(2) A circuit board includes: a dielectric substrate; a ground electrode formed on the dielectric substrate; a radiation line formed on the dielectric substrate, at least a part of the radiation line including an open end and opposed to the ground electrode; a feeding line connected to the other end of the radiation line, the feeding line configured to feed high frequency signals to the radiation line or receive high frequency signals generated in the radiation line; a short-circuit element configured to short-circuit the radiation line and the ground electrode; and a connection terminal provided on the radiation line, wherein the connection terminal connects one end of the short-circuit element to the radiation line at a connection position and is configured so that the connection position is changeable.

According to the above configuration, an antenna is formed on a circuit board, as in the circuit board of (1), by the ground electrode and radiation line formed on a dielectric substrate and the feeding line connected to the other end of the radiation line. Also, since the radiation line and the ground electrode are short-circuited by a short-circuit element, the parasitic capacitance (reactance component) occurring at the opposed portion of the radiation line and the ground electrode is cancelled by an inductance component of the short-circuit element Accordingly, the resonance characteristics of the antenna can be improved. Herein, since the radiation line is provided with a connection terminal by which a connection terminal that connects one end of the short-circuit element to the radiation line at a connection position and the connection terminal is configured so that the connection position is changeable, the connection position of the short-circuit element at the radiation line side can be changed after an antenna is formed on the circuit board. Accordingly, since the electric length from the other end of the radiation line, which is a connection position of the radiation line with the feeding line, to the connection portion of the short-circuit element with the ground electrode is changed if the connection position of the short-circuit element at the radiation line side is changed, the resonance frequency of the antenna formed on the circuit board can be changed. Accordingly, such an effect by which the characteristics of the antenna can be adjusted after the antenna is formed is brought about. In addition, where dielectric substrates having different dielectric constants are used, the antenna formed on the circuit board can be matched to desired characteristics if the connection position of the short-circuit element at the radiation line side is changed according to the dielectric constant. Therefore, such an effect can be brought about, by which it is possible to save work for designing the antenna in compliance with the dielectric constant of the dielectric substrates.

(3) In the circuit board according to (1) or (2), the connection terminal may be configured so that a connectable position, at which the one end of the short-circuit element is capable of connecting to the connection terminal, extends continuously.

According to the above configuration, the characteristics of the antenna can be minutely adjusted.

(4) In the circuit board according to (1) or (2), the connection terminal may be configured so that a plurality of connectable positions are provided, at which the one end of the short-circuit element is capable of connecting to the connection terminal.

According to the above configuration, the characteristics of the antenna can be adjusted in plural stages.

(5) In the circuit board according to any one of (1) to (4), the connection terminal may be formed by patterning a conductor at an outer edge of the short-circuit line or the radiation line.

According to the above configuration, the connection terminals can be used as marks of the connection positions where one end of the short-circuit element is connected to the connection terminals.

(6) The circuit board according to any one of (1) to (4), may further comprise an insulative coating film which coats the short-circuit line or the radiation line. The connection terminal may be formed by removing the insulative coating film so that the short-circuit line or the radiation line is exposed.

According to the above configuration, it is possible to prevent the characteristics of the antenna from deteriorating due to deformation in shape of the short-circuit line or the radiation line where the connection terminals are formed on the short-circuit line or the radiation line. Accordingly, the characteristics of the antenna can be kept satisfactory.

(7) In the circuit board according to any one of (1) to (4), the connection terminal may include a hole formed on the short-circuit line or the radiation line, and the short-circuit element may be fitted into the connection terminal.

According to the above configuration, the connection terminals can be easily formed. In addition, positioning thereof can be easily carried out.

(8) In the circuit board according to any one of (1) to (7), the short-circuit element may include a zero-ohm resistor element.

According to the above-described circuit board, since a zero-ohm resistor element is used as the short-circuit element the resistance component at the short-circuited portion can be limitlessly reduced. Therefore, such an effect can be brought about by which the resonance characteristics of the antenna can be prevented from deteriorating due to the resistance component of the short-circuited portion.

(9) A telephone apparatus for carrying out a wireless communication, includes: a circuit board according to any one of (1) to (8); and a signal processing circuit configured to generate the high frequency signals fed to the circuit board and process the high frequency signals received from the circuit board.

According to the above configuration, the characteristics of an antenna formed on the circuit board can be adjusted at any time. In addition, where a circuit board using dielectric substrates having different dielectric constants is used, the characteristics of the antenna formed on the circuit board can be matched to desired characteristics according to the dielectric constants. Accordingly, it is possible to save labor in redesigning the antenna in compliance with the dielectric constant of the dielectric substrates.

What is claimed is:

1. A circuit board comprising:

a dielectric substrate;

a ground electrode formed on the dielectric substrate;

a radiation line formed on the dielectric substrate, at least a part of the radiation line including an open end and opposed to the ground electrode;

a feeding line connected to the other end of the radiation line, the feeding line configured to feed high frequency signals to the radiation line or receive high frequency signals generated in the radiation line;

a short-circuit line formed on the dielectric substrate and connected to the radiation line;

a short-circuit element configured to short-circuit the short-circuit line and the ground electrode, the short-circuit element being a single element; and a connection terminal provided on the short-circuit line, wherein the connection terminal connects one end of the short-circuit element to the short-circuit line at a connection position and is configured so that the connection position is changeable.

2. The circuit board according to claim 1, wherein the connection terminal extends continuously along the short-circuit line so that a connectable position, at which the one end of the short-circuit element is capable of connecting to the connection terminal, is continuously changeable along the short-circuit line.

3. The circuit board according to claim 1, wherein the connection terminal is configured so that a plurality of connectable positions are provided, at which the one end of the short-circuit element is capable of connecting to the connection terminal.

4. The circuit board according to claim 1, wherein the connection terminal is formed by patterning a conductor at an outer edge of the short-circuit line.

5. The circuit board according to claim 1, further comprising an insulative coating film which coats the short-circuit line or the radiation line, wherein the connection terminal is formed by removing the insulative coating film so that the short-circuit line is exposed.

6. The circuit board according to claim 1, wherein the connection terminal includes a hole formed on the short-circuit line, and wherein the short-circuit element is fitted into the connection terminal.

7. The circuit board according to claim 1, wherein the short-circuit element includes a zero-ohm resistor element.

8. A telephone apparatus for carrying out a wireless communication, comprising:

a circuit board according to claim 1; and a signal processing circuit configured to generate the high frequency signals fed to the circuit board and process the high frequency signals received from the circuit board.

9. The circuit board according to claim 1, wherein the radiation line extends in a same direction as a direction in which the short-circuit line extends.

10. The circuit board according to claim 1, wherein the ground electrode, the radiation line, the feeding line and the short-circuit line are formed on a same surface of the dielectric substrate.

11. A circuit board comprising:

a dielectric substrate;

a ground electrode formed on the dielectric substrate;

a radiation line formed on the dielectric substrate, at least a part of the radiation line including an open end and opposed to the ground electrode;

a feeding line connected to the other end of the radiation line, the feeding line configured to feed high frequency signals to the radiation line or receive high frequency signals generated in the radiation line;

a short-circuit element configured to short-circuit the radiation line and the ground electrode, the short-circuit element being a single element; and a connection terminal provided on the radiation line, wherein the connection terminal connects one end of the short-circuit element to the radiation line at a connection position and is configured so that the connection position is changeable.

12. The circuit board according to claim 11, wherein the connection terminal extends continuously along the radiation line so that a connectable position, at which the one end of the short-circuit element is capable of connecting to the connection terminal, is continuously changeable along the radiation line.

13. The circuit board according to claim 11, wherein the connection terminal is configured so that a plurality of connectable positions are provided, at which the one end of the short-circuit element is capable of connecting to the connection terminal.

14. The circuit board according to claim 11, wherein the connection terminal is formed by patterning a conductor at an outer edge of the radiation line.

15. The circuit board according to claim 11, further comprising an insulative coating film which coats the radiation line, wherein the connection terminal is formed by removing the insulative coating film so that the radiation line is exposed.

16. The circuit board according to claim 11, wherein the connection terminal includes a hole formed on the radiation line, and wherein the short-circuit element is fitted into the connection terminal.

17. The circuit board according to claim 11, wherein the short-circuit element includes a zero-ohm resistor element.

18. The circuit board according to claim 11, wherein the ground electrode, the radiation line and the feeding line are formed on a same surface of the dielectric substrate.

* * * * *